US005816888A

United States Patent [19]

Myers

[11] Patent Number: 5,816,888

[45] Date of Patent: Oct. 6, 1998

[54] REMOTE CONTROLLED THREE-IN-ONE VEHICLE

[76] Inventor: Jeff D. Myers, 7525 N. Shadow Mountain Rd., Paradise Valley, Ariz. 85018

[21] Appl. No.: 740,557

[22] Filed: Oct. 30, 1996

[51] Int. Cl.[6] ..... A63H 30/04; A63H 17/26

[52] U.S. Cl. ..... 446/456; 446/471

[58] Field of Search ..... 446/429, 454, 446/455, 456, 4, 470, 471, 435, 436, 437, 475

[56] References Cited

U.S. PATENT DOCUMENTS

| | | | |
|---|---|---|---|
| 3,959,920 | 6/1976 | Ieda | 446/6 |
| 4,188,748 | 2/1980 | Rich et al. | 446/471 X |
| 4,189,864 | 2/1980 | Saito | 446/471 X |
| 4,540,379 | 9/1985 | Tachibana | 446/437 X |
| 4,911,669 | 3/1990 | Parker | 446/435 X |
| 4,986,789 | 1/1991 | Hang | 446/470 X |
| 5,334,078 | 8/1994 | Hippely et al. | 446/470 |
| 5,380,231 | 1/1995 | Brovelli | 446/6 |
| 5,474,486 | 12/1995 | Chilton et al. | 446/456 |

FOREIGN PATENT DOCUMENTS

| | | | |
|---|---|---|---|
| 0 580 937 | 2/1994 | European Pat. Off. | 446/456 |
| 2155343 | 9/1985 | United Kingdom | 446/470 |

*Primary Examiner*—Kien T. Nguyen
*Assistant Examiner*—D. Neal Muir
*Attorney, Agent, or Firm*—Warren F. B. Lindsley

[57] ABSTRACT

A radio controlled model vehicle that sheds one or more outer shells in response to successive radio control signals thereby changing in outer appearance from one type of vehicle to another or revealing an animated monster or other figure that had been hidden by an outer shell.

3 Claims, 4 Drawing Sheets

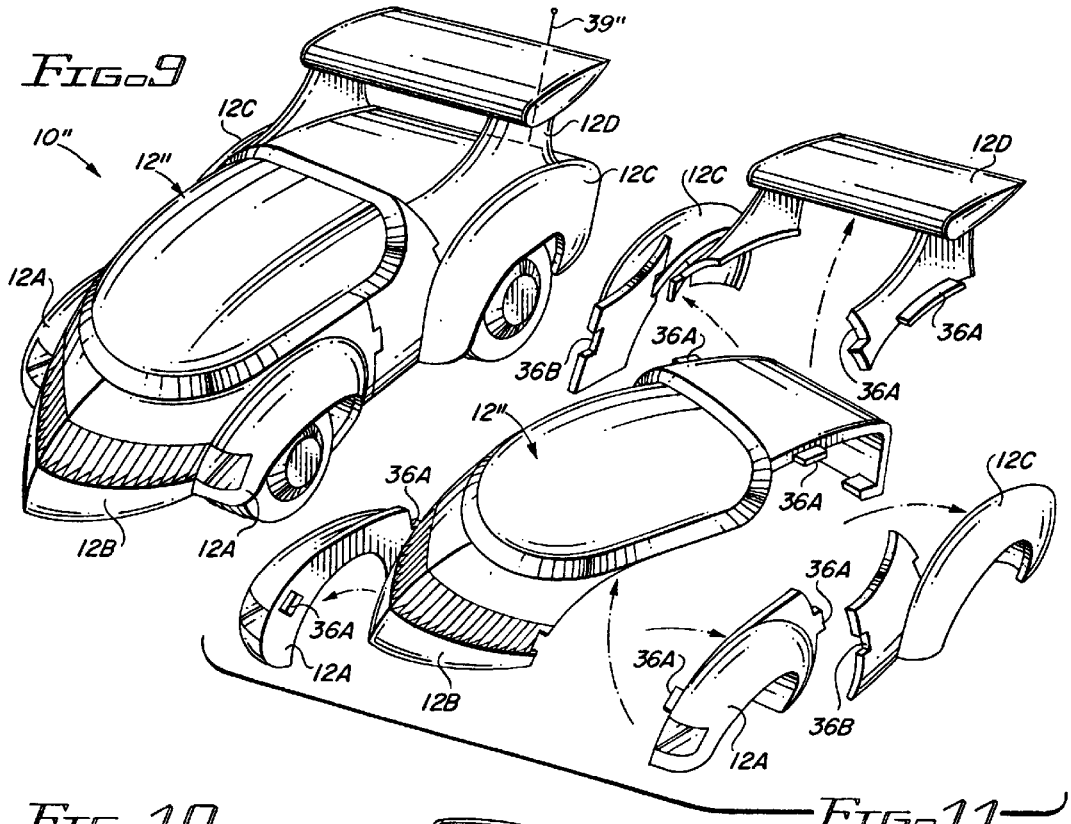
FIG. 9
FIG. 11
10"
12"
12A
12B
12C
12D
36A
36B
39"
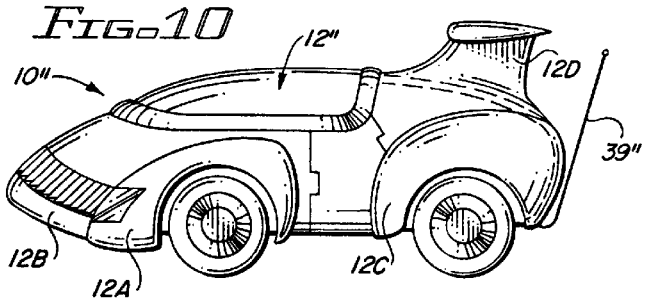
FIG. 10
10"
12"
12A
12B
12C
12D
39"
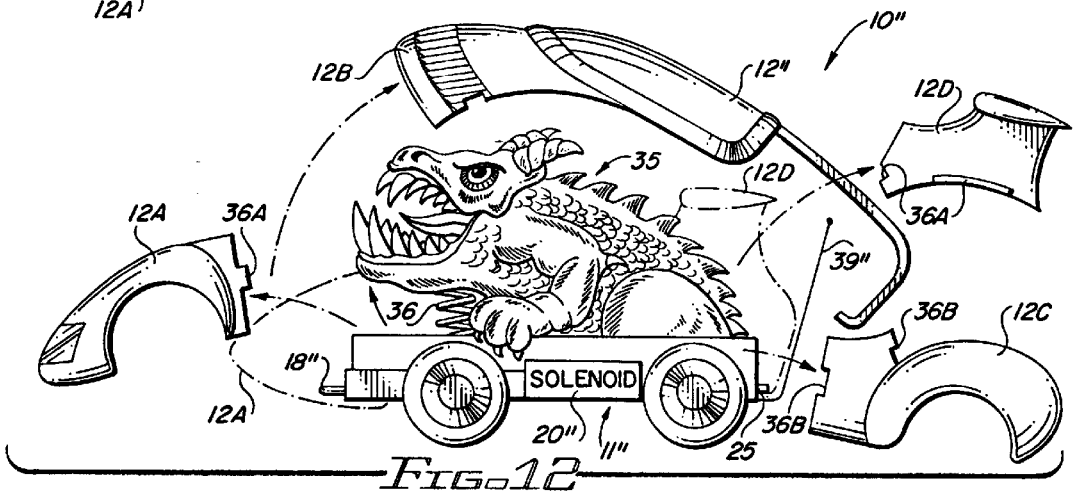
FIG. 12
10"
12"
12A
12B
12C
12D
35
36
36A
36B
39"
18"
20"
11"
25
SOLENOID

REMOTE CONTROLLED THREE-IN-ONE VEHICLE

BACKGROUND OF THE INVENTION

This invention relates to toys and, more particularly, to sophisticated radio controlled model vehicles that change character in response to a remote command by shedding an outer shell.

Toys from the earliest days have been a necessary constituent of human health and development. Competition has produced countless ingenious contrivances which are models of cars, tanks, airplanes and the like, many of which are remotely controlled by radio transmitter-receiver equipment for movement and equipment functions. The present invention provides new features for enhanced interest and excitement.

DESCRIPTION OF THE PRIOR ART

Many toys are model machines of known equipment and particularly objects such as cars, trucks and various military vehicles. Some of the military vehicles have been known to dispense projectiles but none of the prior art vehicles are known to convert from one form or type of vehicle to another in response to a radio control signal.

SUMMARY OF THE INVENTION

This invention relates to radio controlled model vehicles that shed one or more outer body shells in response to successive radio control signals, thereby changing in outer appearance from one type of vehicle to another.

It is, therefore, one object of this invention to provide a new and improved model vehicle that changes character upon command.

Another object of this invention is to provide a new and improved model vehicle that sheds an outer shell to convert from one type of model vehicle to another.

A still further object of this invention is to provide a self-propelled model vehicle that is controlled by radio signals transmitted from a remote control panel and also converts from one form to another in response to another radio control panel.

A still further object of this invention is to provide such an improved model vehicle in which such conversion may be accomplished while the model vehicle is in motion as well as while the vehicle is stationary.

A still further object of this invention is to provide such an improved model vehicle in which one or more outer shells may be removed in succession, uncovering thereby at each removal a vehicle body of a different type or character.

Further objects and advantages of the invention will become apparent as the following description proceeds and the features of novelty that characterize the invention will be pointed out with particularity in the claims annexed to and forming a part of this specification.

BRIEF DESCRIPTION OF THE DRAWINGS

The present invention may be more readily described with reference to the accompanying drawings, in which:

FIG. 9 is a perspective view of another embodiment of an explodable vehicle;

FIG. 10 is a side view of FIG. 9;

FIG. 11 is a perspective view of the exploding parts of FIGS. 9 and 10; and FIG. 12 illustrates another embodiment of the invention wherein the outer shell is ejected to expose the figure of a monster;

DESCRIPTION OF THE PREFERRED EMBODIMENT

Referring more particularly to the drawings by characters of reference, FIGS. 1–4 disclose the convertible three-in-one vehicle 10 of the invention comprising a core vehicle 11 over which are positioned first and second nesting auxiliary outer shells 12 and 13 which are removable one at a time in response to successive radio commands. It should be noted that the term "vehicle" is intended here to mean all forms of model cars, trucks, boats, aircraft and the like.

Figure 1:
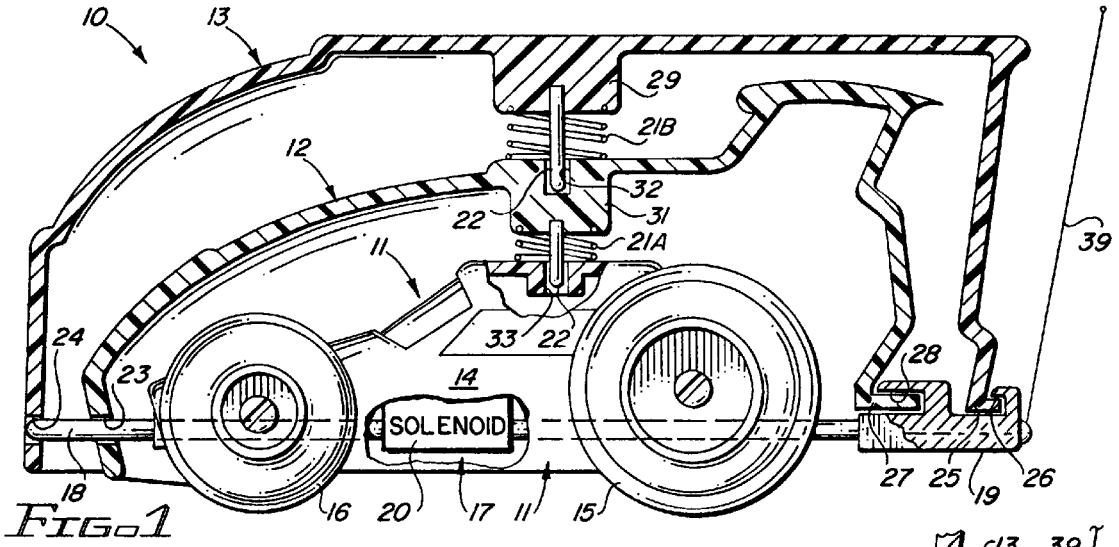
FIG. 1 is a side view of a first embodiment of the radio controlled model vehicle shown partially cross-sectioned to illustrate the nested body shells that are successively shed to change the character of the vehicle.

Core vehicle 11 is a modified version of prior art radio controlled vehicles that incorporate means for being driven in the forward and reverse directions and for being steered to the left or the right in response to radio frequency signals transmitted from a remote control panel. As shown in FIG. 1, core vehicle 11 comprises a body 14, rear wheels 15, front wheels 16, a shell release mechanism 17, vehicle drive and steering means, a radio receiver and control circuits. Release mechanism 17 extends the full length of the convertible vehicle 10, terminating at the forward end in a retainer pin 18 and terminating at the rearward end of the vehicle in a special dual action retainer clip 19.

Figure 2:
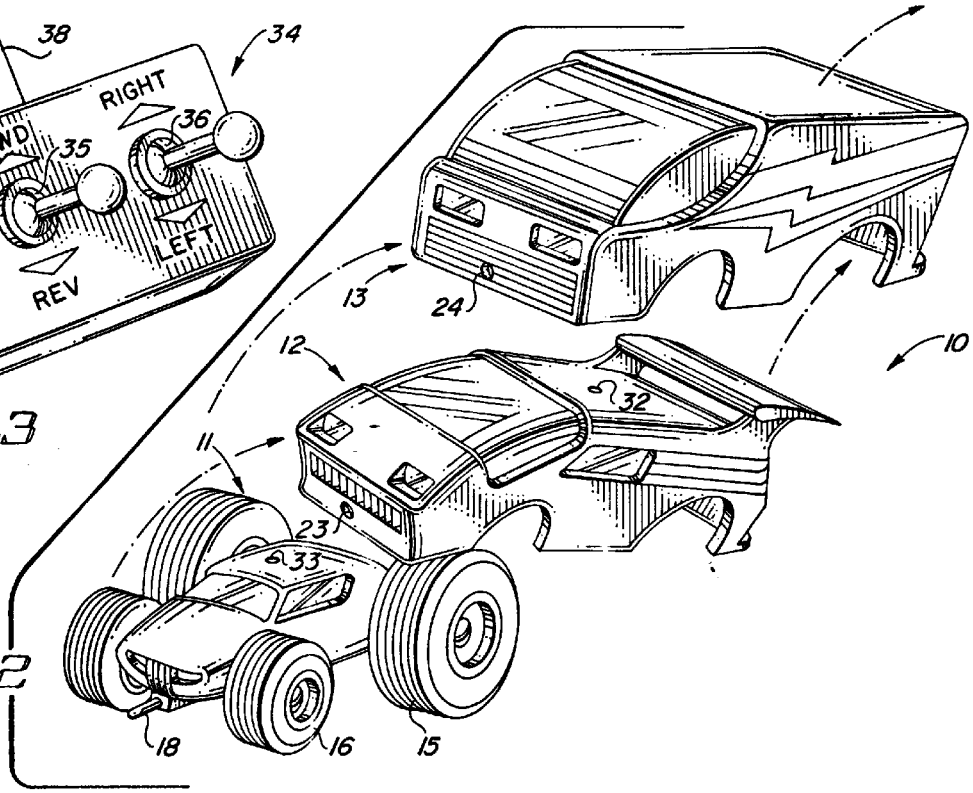
FIG. 2 is a perspective view illustrating the shedding of the outer shells in response to a radio command from a remote control panel.

As shown in FIGS. 1 and 2, auxiliary outer shell 12 has somewhat greater overall dimensions than those of core vehicle 11 and is markedly different in appearance and character. Outer shell 13 has somewhat greater outer dimensions than those of shell 12 and is markedly different in appearance and character from shell 12 and core vehicle 11. In the nested condition shown in FIG. 1, shell 12 fits snugly over the outer contours of core vehicle 11 and shell 13 fits snugly over the outer contours of shell 12 so that the positions of the nesting shells relative to each other and to the core vehicle are secure and closely defined.

Shells 12 and 13 are pierced at their lower front extremities to mate with retainer pin 18 of release mechanism 17 and they are specially formed at their lower rearward extremities to mate with retainer clip 19. Each of the shells 12 and 13 is also equipped with an ejection spring 21A and 21B, respectively. An optional positioning pin 22 is also shown in conjunction with each of the springs 21A, 21B to insure the proper alignment of the shells 12 and 13 in the nested position.

Release mechanism 17 comprises a spring-loaded solenoid 20. In its non-energized condition its shaft is driven toward the forward end of core vehicle 11 so that pin 18 extends through mating aligned opening 23 of shell 12 and aligned opening 24 of shell 13. With retainer clip 19 also in its forward position as shown in FIG. 1, the specially formed lower rearward extremities of shells 12 and 13 are also secured by retainer clip 19. Note that the lower rearward edge of shell 13 is formed to create a tab 25 extending rearwardly. In the retaining position of mechanism 17, tab 25 is captured within a cavity 26 of clip 19 that faces forward. Similarly, a somewhat longer rearwardly projecting tab 27 is provided at the lower rearward extremity of shell 12. Tab 27 is captured within a mating cavity 28 of clip 19, that also faces forward. These interlocking tabs and cavities secure the rearward ends of shells 12 and 13 while the pin 18 projecting through openings 23 and 24 secures their forward ends to core vehicle 11.

Ejection spring 21A of shell 12 is vertically mounted inside shell 12 and is secured to the upper inner surface of shell 12 in an approximately centered position. As shown in FIG. 1, spring 21B of shell 13 is compressed between shells 12 and 13 while shell 13 is retained by mechanism 17. Depending upon the compressed dimension of spring 21B relative to the spacing between shells 12 and 13 at the spring location the thickness of shell 13 may need to be augmented by a downwardly projecting spring mounting pedestal 29, the pedestal 29 serving to insure the compression of spring 21.

Spring 21A of shell 12 is shown similarly mounted inside shell 12 to a centered spring mounting pedestal 31 and is compressed in the retained condition of shell 12 between shell 12 and the top surface of core vehicle 11.

Positioning pin 22 of shell 13 projects vertically downward from pedestal 29 into an aligned opening 32 of shell 12, and positioning pin 22 of shell 12 extends vertically downward from pedestal 31 into an aligned opening 33 in the top of core vehicle 11.

Figure 3:
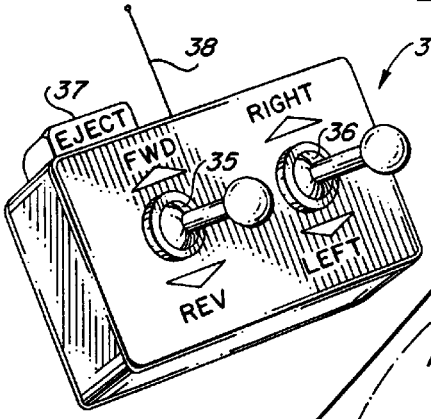
FIG. 3 is a perspective view of a remote control panel employed to command the ejection of the outer body shells.

Core vehicle 11 is controlled from remote control panel 34 as shown in FIG. 3. Panel 34 comprises the conventional FWD/REV and RIGHT/LEFT core vehicle drive and steering controls 35 and 36, respectively, and an additional shell ejection switch 37. An internal transmitter responds to the manipulation of these switches to transmit the resulting command from control panel transmitting antenna 38 to core vehicle receiving antenna 39. Electronic circuits incorporated within core vehicle 11 interpret and respond to specific commands received from control panel 34, driving the vehicle in forward or reverse directions and steering to the left or the right as in the case of prior art radio controlled vehicles.

It has been shown that in the absence of a command to release and eject one of the shells 12 or 13, the unenergized mechanism 17, driven forward by its integral spring, secures the nested shell or shells in position atop core vehicle 11.

When it is desired to eject a shell, the ejection command is executed at the remote control panel 34 by depressing shell ejection switch 37. An ejection signal is immediately transmitted to core vehicle 11 where it is decoded and executed by energizing the solenoid of release mechanism 17. Assuming that both shells 12 and 13 are in position atop core vehicle 11, the shaft of mechanism 17 is driven rearwardly to release outer shell 13.

Figure 4:
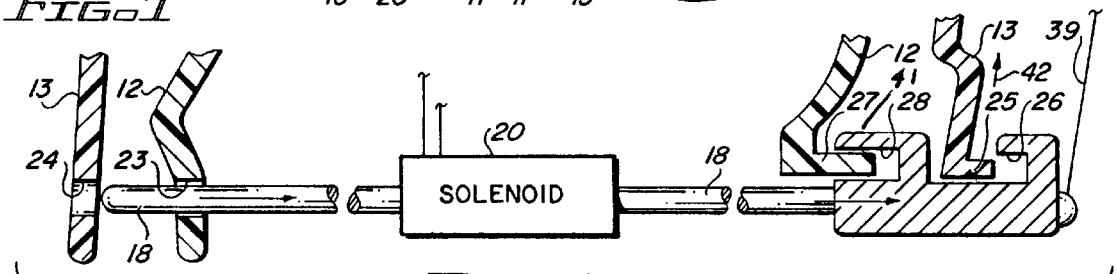
FIG. 4 is a cross-sectional view of the release mechanism showing the relative positions of two members of the mechanism at the instant the outermost shell is released.

In order to release shell 13 while not releasing shell 12 at the same time the travel of the solenoid shaft must be limited so that pin 18 is withdrawn from opening 24 of shell 13 but not from opening 23 of shell 12 and so that tab 25 is withdrawn from cavity 26 but tab 27 is not withdrawn from cavity 28. With shell 13 present, such limited travel is illustrated in FIG. 4. As shown in FIG. 4, clip 19 moves rearwardly until further travel is limited by contact of shoulder 41 with the inside edge of shell 13, shoulder 41 comprising the shell surrounding cavity 28.

In the position of limited solenoid travel shown in FIG. 4 it is seen that tab 25 of shell 13 has been freed from cavity 26, while the longer tab 27 of shell 12 has not been freed from cavity 28. Under the force of spring 21B of shell 13 the rearward end of shell 13 is driven upward as indicated by arrow 42. Meanwhile, pin 18 has been withdrawn from opening 24, thereby releasing the forward end of shell 13 but pin 18 has stopped short of withdrawal from opening 23.

The force of spring 21B is adequate to very forcibly eject shell 13 so that it travels clear of the remaining form of vehicle 10 which may itself be in motion at the time.

If solenoid 20 of mechanism 17 were to remain energized following the ejection of shell 13, the shaft of the solenoid together with pin 18 and clip 19 would then be free to resume movement rearwardly to release shell 12. To prevent such a resumption of solenoid travel, the energization of the solenoid is limited to a very short time interval that does not extend beyond the ejection time of shell 13.

If shell 13 has been removed previous to the time that ejection switch 37 is actuated, solenoid travel with shell 13 not present as a barrier will be sufficient to withdraw pin 18 from opening 23 of shell 12 and sufficient to withdraw tab 27 from cavity 28 of clip 19, whereupon both ends of shell 12 are released and shell 12 is ejected under the force of its ejection spring 21A.

Figure 5:
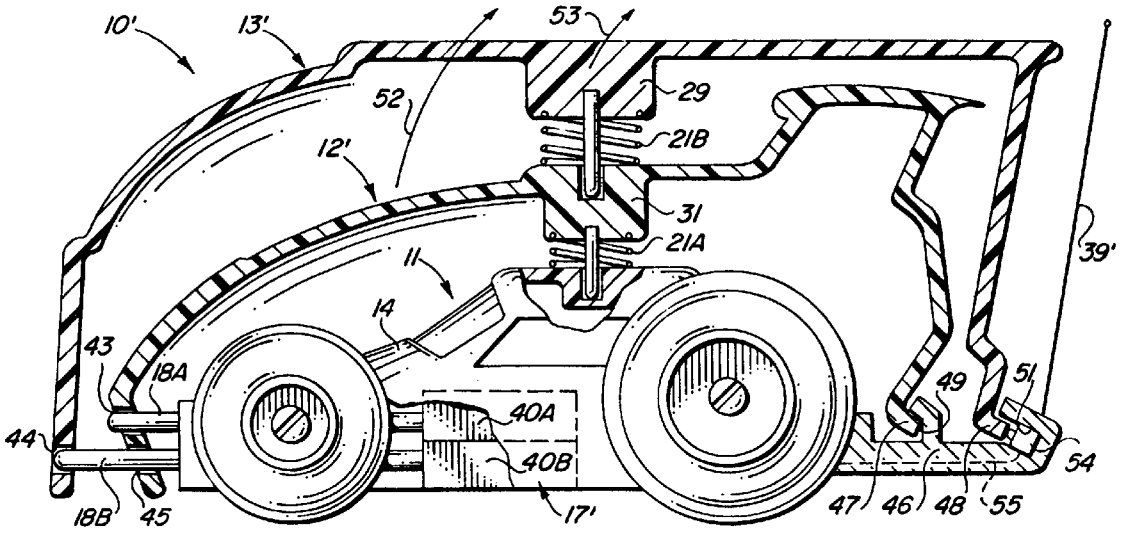
FIG. 5 is a cross-sectional view of the radio controlled model vehicle of the invention illustrating a second embodiment of the release mechanism.

An alternate version of the three-in-one vehicle 10 is shown as vehicle 10' in FIG. 5, the vehicle 10' comprising a core vehicle 11', a first nesting shell 12' and a second nesting shell 13'.

Vehicle 10' differs from vehicle 10 only with respect to the means for securing the shells to the core vehicle and the means for releasing the shells, one at a time. Vehicle 10' has a release mechanism 17' that incorporates two solenoids 40A and 40B rather than one. Each of the two solenoids engages one of two pins, 18A and 18B that extend through aligned holes at the forward ends of shells 12' and 13' with pin 18A extending through hole 43 of shell 12' and pin 18B extending through hole 44 of shell 13' and through clearance hole 45 of shell 12'. At the rear end of vehicle 11' a stationary (relative to vehicle 11') retainer clip 46 is provided for securing the rearward lower edges of shells 12' and 13'. As shown in FIG. 5, the lower edges of shells 12' and 13' are curved rearwardly at their lower extremities to form tabs 47 and 48, respectively, that are engaged by shallow openings 49 and 51, respectively, on the upper surface of retainer clip 46. The openings 49 and 51 and the tabs 47 and 48 are curved or specially contoured so that the tabs 47 and 48 will be released when the forward ends of the shells are released and the shells are pivoted upwardly and rearwardly as illustrated by the arrows 52 and 53. In addition, a microswitch 54 is incorporated inside cavity 51 to detect the presence or absence of shell 13.

Ejections of shells 12' and 13' are controlled as follows:

When both shells are present switch 54 is closed by contact with the lower edge of tab 48, thus producing a short circuit across a pair of wires 55 that are routed to the control circuit internal to release mechanism 17'.

The ejection operations for vehicle 10' occur as follows:

First, assume both shells 12' and 13' are present and it is desired to eject only shell 13'.

When the ejection switch 37' of control panel 34' is actuated and the ejection command is received by core vehicle 11' a short circuit will be present across wires 55 due to the presence of shell 13'. The short circuit will disable the drive to solenoid 40A if the short is present at the initiation of the ejection command. With the drive to solenoid 40A disabled, only solenoid 40B will be energized with the result that pin 18A will remain extended to retain shell 12' while pin 18B will be fully withdrawn to release shell 13'. As pin 18B is withdrawn from hole 44, shell 13' is driven upwardly, tilting about cavity 51 as indicated by arrow 53, whereupon it becomes completely released and falls free as vehicle 10' continues moving along with shell 12' exposed.

Some time later when it is decided to eject shell 12', the ejection switch 37' is again actuated. This time with shell 13' already absent there is no short circuit across wires 55 and both solenoids 40A and 40B are energized. Both pins 18A and 18B are thus fully withdrawn from holes 43 and 45, thereby releasing the forward end of shell 12'. Shell 12' is then ejected by the force of spring 21A and is freed from vehicle 11' as it tilts upwardly and rearwardly as suggested by arrow 52, pivoting free from cavity 49 and exposing core vehicle 11'.

Figure 6:
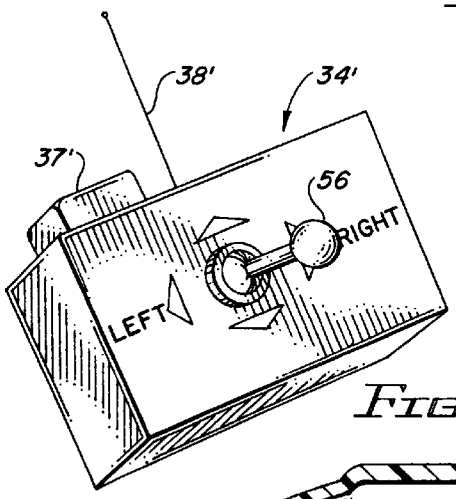
FIG. 6 is a perspective view of the second embodiment of the remote control panel.

Prior art remote control vehicles sometimes employ a single control known as a joy stick to control the motion and steering of the vehicle. FIG. 6 shows the use of such a control at the remote control panel 34' of the present invention. In this version, the control panel comprises the ejection switch 37', the joy stick 56, the antenna 38' and internal control and transmission circuits.

Figure 7:
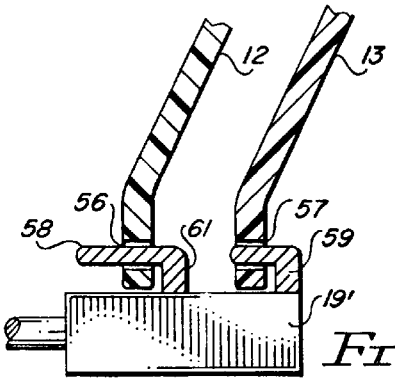
FIG. 7 is an illustration of an alternate version of a retainer clip employed for releasing the nested shells of the vehicle shown in FIG. 1.

FIG. 7 shows a variation of the dual action retainer clip 19' of core vehicle 10. In this version, the tabs 27 and 25 at the lower edges of shells 12 and 13 are replaced by holes 56 and 57 at the lower rear edges of shells 13 and 12, respectively, and the cavities 28 and 26 are replaced by bent pins 58 and 59. The pins 58 and 59 are bent forward at 90 degrees to pass through the holes 56 and 57, respectively, to secure the shells 12 and 13. If both shells are present when the solenoid is actuated, solenoid travel to the right will be momentarily terminated when the rear surface 61 of pin 58 contacts the inside surface of shell 13. At this point, the end of pin 58 will still engage hole 56 of shell 12 and pin 18 at the front of vehicle 10 will still extend through hole 23 preventing the release of shell 12 in the manner discussed in connection with the first embodiment of FIGS. 1–4.

Figure 8:
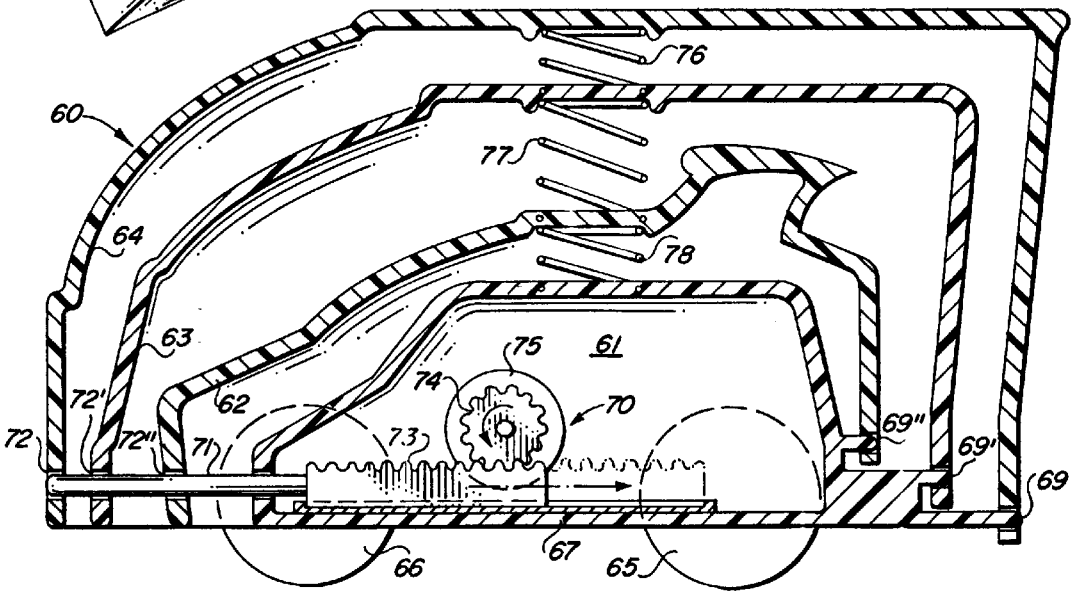
FIG. 8 is a cut-away side view of another embodiment of the invention incorporating a different means for releasing the nested outer shells.

Another embodiment of the invention, as shown in FIG. 8, comprises a convertible vehicle 60 incorporating a core vehicle 61 with nesting shells 62, 63 and 64.

Core vehicle 61 comprises front and rear wheels 65 and 66, respectively, and a frame 67.

The shells 62–64 are secured at the rear of frame 67 by fixed hooks 69 that pass through holes in the lower edges of the shells. The forward ends of the shells are secured by a movable rod 71 that passes through and engages aligned holes 72 in the forward ends of the shells.

To release the shells consecutively, one at a time, the rod 71 is driven by a release mechanism 70 comprising a rack 73, pinion 74 and a stepping motor 75. The rack 73 is integral with and extends directly from the rod 71. The stepping motor 75 drives the pinion 74 and the pinion 74 engages and drives the rack 73.

Each time an ejection command is received from the remote control panel (FIG. 3 or FIG. 6) via a receiving antenna and control circuit located (but not shown) on the core vehicle 61 the stepping motor 75 and pinion 74 advance the rack 73 a fixed distance rearwardly as needed to release the outermost shell. If all three shells are present at the time the command is received the rod 71 will move just far enough to exit and disengage the hole 72' of shell 64. When the next ejection command is received, the rod 71 moves just far enough to clear the hole 72" of shell 63, etc.

As in the case of the embodiments described earlier, the shells 62–64 are ejected by springs 76–78 once they are released. Spring 76, attached to the inner surface of shell 64 and bearing against the outer top surface of shell 63 drives shell 64 upwardly as shell 64 is released. Similarly, spring 77 attached to shell 63 bears against shell 62, to eject shell 63 and spring 78 secured to shell 62 bears against core vehicle 61 to eject shell 62.

The hooks 69, 69' and 69" at the rear of vehicle 61 are shaped so that as the ejecting shell is driven upwardly and pivots rearwardly it becomes disengaged from hooks 69, 69' and 69" and falls away from the vehicle 60.

Another embodiment of the invention is shown in FIGS. 9 through 12. FIGS. 9 and 10 show a radio-controlled model vehicle 10" with an outer shell 12" resembling a race car. The vehicle 10" incorporates equipment similar to that already described in connection with vehicles 10 and 10' including an antenna 39", radio receiver control circuits, drive and steering means, shell release mechanism, etc. (not shown).

As noted vehicle 10" comprises detachable front and rear fenders 12A and 12C, nose 12B of the vehicle, and airfoil 12D. FIG. 11 illustrates the connecting tabs 36A and 36B for reassembling the vehicle.

When shell 12" is released and ejected as shown in FIG. 12, the core vehicle 11" is seen to comprise the form of a monster 35 riding upon the open bed of the vehicle and biased outwardly thereof by a spring 36.

Many variations of this version may be provided, using animal figures of different types various caricatures of humans and so forth. In addition, the monster or other figure may be animated through the incorporation of radio controlled mechanisms that produce movement of the figures such as movement of monster's jaws.

Figure 13:
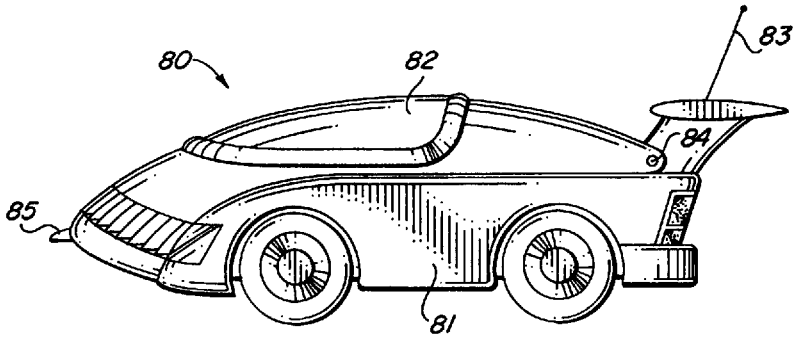
FIGS. 13 and 14 illustrate yet another embodiment of the invention wherein the outer or upper body shell is hinged to the core vehicle and springs open to expose the figure of a monster.
Figure 14:
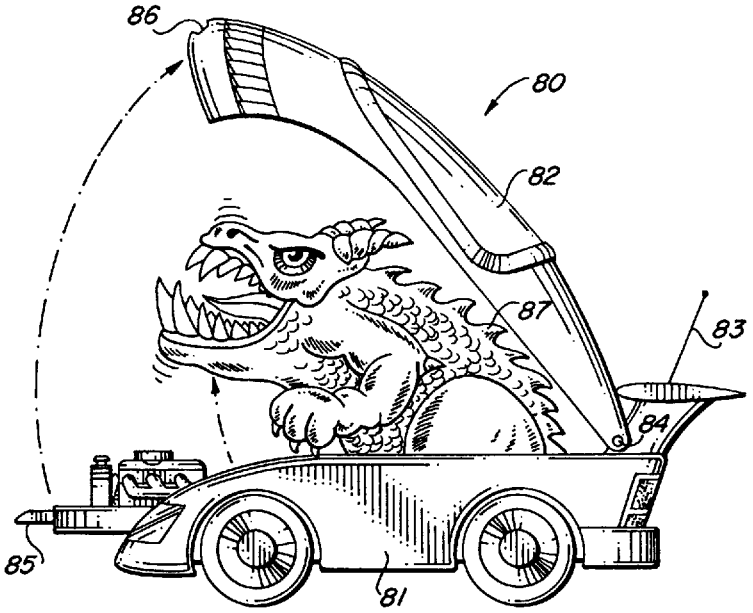

Yet another embodiment of the invention is shown in FIGS. 13 and 14. FIG. 13 shows a radio-controlled model vehicle 80 comprising a core vehicle 81 and an upper body shell 82.

Core vehicle 81 again incorporates equipment similar to that described in connection with vehicles 10, 10' and 10" including an antenna 83, radio receiver circuits, drive and steering means and shell release mechanisms. Preferably, it also includes lower body shell components such as fenders, rear bumper, air foil, etc.

Upper body shell 82 is a single-piece upper body cover or enclosure secured at the rear of the vehicle by a spring-loaded hinge 84 and at the front by a solenoid controlled, spring-loaded latch 85.

When the solenoid that controls latch 85 is not energized, latch 85 is driven forward in an extended position by the solenoid spring so that when shell 82 is in its lowered position as shown in FIG. 13, the latch 85 passes through a mating opening 86 in the nose of shell 82 to secure the lowered or closed position of shell 82. As shown in FIGS. 13 and 14, latch 85 may have a tapered upper edge similar to the common household door latch so that it opens to receive the mating opening 86 as the shell 82 is slammed shut. When the solenoid is subsequently energized by radio control, the latch 85 is withdrawn from opening 86 by the solenoid. The forward end of shell 82 is thereby released, and the loading spring of hinge 84 drives shell 82 to the opened position shown in FIG. 14.

Mounted inside the core vehicle 81 as shown in FIG. 14 is a rubber monster FIG. 87 that is revealed as shell 82 opens. As an optional feature, a radio-controlled actuator may be incorporated that will produce movement of the monster's jaws or other features when the actuator is energized.

In the operation and use of the toy vehicle 80, the operator would first manually secure the shell 82 in its closed position. After moving the vehicle about for a desired period of time with the shell 82 closed, the operator would then press the eject button on the remote control panel 34. This causes the latch 85 to be released and allows the shell 82 to spring apart from the core vehicle 81 in a manner resembling the opening of a clam shell. The same signal that commands the release of latch 85 might also energize the actuator that produces animated movement of the monster 87. Subsequent momentary depressions of the eject button would thus produce repeated monster animation episodes, thereby providing enhanced interest and excitement for the operator and for those witnessing its operation.

The vehicle 80 may take any form and the monster 87 may also take any of a variety of forms. Comic figures of various types might also be substituted for the monster figure without departing from the spirit of the invention or from the scope of the appended claims.

What is claimed is:

1. A model vehicle that changes character by shedding an outer shell in response to a command from a remotely located transmitter transmitting radio signals to a receiver on the vehicle, said model vehicle comprising:

a vehicle;

a core vehicle mounted within said vehicle;

a transmitter for transmitting radio signals to said core vehicle;

a receiver mounted on said core vehicle for receiving said radio signals from said transmitter;

a control circuit mounted on said core vehicle for receiving signals from said receiver;

more than one outer shell nested at least partially around said core vehicle and forming at least a part of the outer surface of said vehicle and having a front end and a rearward end;

a first means mounted on said core vehicle and actuated by signals received from said control circuit for moving and steering said core vehicle;

a second means on each of said outer shell for movably mounting at said front and rearward ends of each said outer shell onto said core vehicle;

a third means for detaching one of said outer shells from said core vehicle at least one end of said outer shell and ejecting at least one end of one of said outer shells from said core vehicle;

whereby a command signal generated by said transmitter and received by said receiver is interpreted and executed by said control circuit for causing said vehicle to move in a forward or reverse direction, to turn to the left or to the right and to eject one of said outer shells from at least partially around said core vehicle to change the appearance of said model vehicle; and a fourth means for preventing more than one outer shell from being ejected at one time comprising a mechanical interference means positioned between an release mechanism and one of the outer nested shells.

2. The model vehicle set forth in claim 1 wherein:

said fourth means for preventing more than one nested shell from being ejected comprises:

a pair of solenoids;

a pair of retainer pins; and a microswitch for sensing the presence of more than one outer shell;

whereby the presence of more than one of said outer shells closes said microswitch thereby disabling one of said solenoids and preventing the withdrawal of one of said retainer pins and thereby preventing the ejection of a second nested shell.

3. The model vehicle set forth in claim 1 wherein:

said model vehicle comprises at least a pair of nested shells; and said means for detaching said nested shells comprising:

hook means for engaging each of said nested shells at their rearward ends with said core vehicle;

a rod engaging aligned holes at the front ends of said shells;

a stepping motor energized by said control circuit for driving said rod a fixed distance each time an ejection command is received out of said aligned holes; and an ejection spring means, one associated with each of said nested shells for moving said shells relative to said core vehicle;

whereby said rod is driven by said stepping motor and by a rack and pinion, each time an ejection command is received, a distance sufficient to release only the outermost of said shells and said spring associated with said outermost shell ejecting said outermost shell from said core vehicle which disengages itself from its associated fixed hook as it falls away from said model vehicle.

* * * * *